United States Patent [19]

Grasse

[11] 4,452,492

[45] Jun. 5, 1984

[54] OSCILLATED HEAD WITH BEARING SUPPORT, FOR FLOOR STRIPPING MACHINE

[75] Inventor: Palmer Grasse, 1407 Lee Dr., Glendale, Calif. 91201

[73] Assignee: Palmer Grasse, Glendale, Calif.

[21] Appl. No.: 443,327

[22] Filed: Nov. 22, 1982

Related U.S. Application Data

[63] Continuation-in-part of Ser. No. 329,523, Dec. 10, 1981, Pat. No. 4,365,843, which is a continuation-in-part of Ser. No. 318,827, Nov. 6, 1981, Pat. No. 4,365,842.

[51] Int. Cl.[3] ..... A47L 11/12

[52] U.S. Cl. ..... 299/37; 15/93 R; 30/169

[58] Field of Search ..... 299/37; 30/169, 272 A, 30/272 R; 15/93; 74/42

[56] References Cited

U.S. PATENT DOCUMENTS

| | | | |
|---|---|---|---|
| 3,376,071 | 4/1968 | Stein | 299/37 |
| 4,365,842 | 12/1982 | Grasse | 299/37 |
| 4,365,843 | 12/1982 | Grasse | 299/37 |

*Primary Examiner*—Ernest R. Purser

*Attorney, Agent, or Firm*—William W. Haefliger

[57] ABSTRACT

Apparatus usable in power-operated floor stripping apparatus that includes a frame, a drive carried on the frame, wheels supporting the frame, a handle to guide the frame, and a cutting blade carried by a head which is pivotally mounted to the frame, the apparatus comprising (a) a connecting element having a first tubular part and a second tubular part, those parts having spaced, parallel axes, the second tubular part pivotally connected to the head, (b) a drive shaft extending within the first tubular part, the shaft operatively connectible to the drive to be rotated thereby, (c) the head having two elongated flanges interconnected by a web, the flanges being locally thickened near upper ends of the elongated flanges, to define two lugs, and (d) self lubricated bearing bushings in the lugs to form bearing openings defining a pivot axis parallel to said drive shaft, the bearing openings receiving a bearing shaft connected to the frame.

Also, easily tightenable means clamps a bottom plate that in turn clamp the blade to the bottom of the head; and the drive shaft may carry eccentrics that oscillate the first tubular part and that also urge lubricant from a space between the eccentrics toward annular bearings within the first tubular part.

16 Claims, 13 Drawing Figures

OSCILLATED HEAD WITH BEARING SUPPORT, FOR FLOOR STRIPPING MACHINE

BACKGROUND OF THE INVENTION

This application is a continuation-in-part of my prior application "Blade Holder In Oscillated Head For Floor Stripping Machine", Ser. No. 329,523, now U.S. Pat. No. 4,365,843, filed Dec. 10, 1981, which is a continuation-in-part of my prior application "Connector For Floor Stripping Machine", Ser. No. 318,827, now U.S. Pat. No. 4,365,842 filed Nov. 6, 1981.

This invention relates generally to floor stripping devices, and more particularly concerns improvements in the driving and blade support means for same.

U.S. Pat. No. 3,376,021 discloses a floor stripping machine of the type in which the present invention is usable to great advantage. Such machine incorporates a cutting blade carried by a head pivotally mounted to a frame. Problems with machines as disclosed in that patent include failure of rapidly oscillating, head driving connecting rods and associated parts and bearings; insufficient lubricating of such rods, parts and bearings, undue wear of the oscillating head at its pivots; unwarranted high cost of repair and replacement of such elements; and difficulty with clamping a blade to the bottom side of the head.

SUMMARY OF THE INVENTION

It is a major object of the invention to provide a solution to the above described problems and disadvantages. Basically, the invention is embodied in:

(a) a connecting element having a first tubular part and a second tubular part, said parts having spaced, parallel axes, said second tubular part pivotally connected to the head, (b) a drive shaft extending within said first tubular part, said shaft operatively connectible to the drive to be rotated thereby, (c) the head having two elongated flanges interconnected by a web, the flanges being locally thickened near upper ends of the elongated flanges, to define two lugs, and (d) self lubricated bearing bushings in the lugs to form bearing openings defining a pivot axis parallel to said drive shaft, the bearing openings receiving a pivot shaft connected to the frame.

As will appear, head oscillating eccentrics rotated by the drive shaft may have oppositely facing end faces which flare radially outwardly and axially to urge and guide lubricant toward bearings for the eccentrics. Also, the tubular parts may simply and inexpensively comprise pipe sections interconnected by a plate welded thereto. Further, the blade is easily attachable to the bottom side of the head by fastening means to be described.

Importantly, the following features are noted and enable heavy duty operation when stripping forces are very high:

(e) the head consisting of lightweight metal selected from the group consisting of aluminum, aluminum alloys, magnesium and magnesium alloys, (f) the head having two elongated flanges interconnected by a web, the flanges being locally thickened near upper ends of the elongated flanges, to define two lugs to carry and receive self lubricated bushings for a pivot shaft connected to the frame, (g) the bearing openings defining a pivot axis parallel to said drive shaft.

These and other objects and advantages of the invention, as well as the details of an illustrative embodiment, will be more fully understood from the following description and drawings, in which:

DRAWING DESCRIPTION

DETAILED DESCRIPTION

Figure 1:
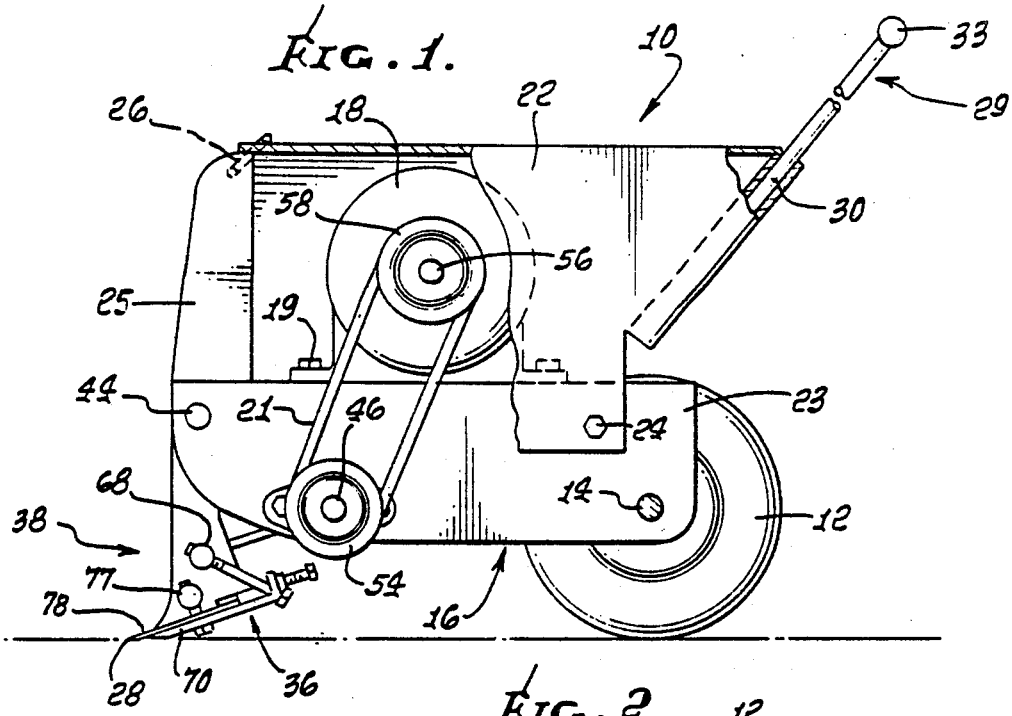
FIG. 1 is a side elevation showing a floor stripping machine incorporating the invention.
Figure 2:
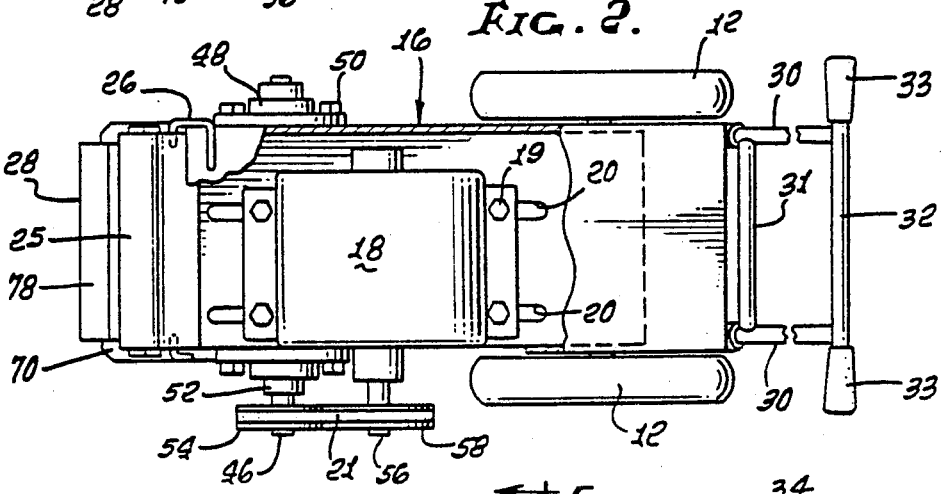
FIG. 2 is a top plan view of the FIG. 1 machine.

Referring now to the drawings and initially, to FIGS. 1 and 2, inclusive, for this purpose, it will be seen that one type of machine in which the invention may be incorporated has been designated in its entirety by reference number 10. Mounted on the machine 10 are a pair of rubber tires 12 which permit the machine 10 to be easily transported and maneuvered. The wheels 12 are carried by an axle 14 which in turn passes through the rear portions of the base frame 16. Mounted on the frame 16 is an electrical motor 18. The machine 10 may alternately be powered by an internal combustion engine. The motor 18 is held in place by four mounting bolts 19 which pass through slots 20 in the frame 16. When the bolts 19 are loosened the motor can be moved forward or backward on the frame 16 by reason of the slots 20 to adjust the tension in the drive belt 21. Covering the motor 18 and attached to the frame 16 is a cover shroud 22. The shroud 22 slides over the side walls 23 of the frame and is held in place by bolts 24 as can be seen in FIG. 1. Positioned on the front of the frame 16 is a nose weight 23. The weight is held in place by means of a releasable wire clip 26 which fastens the forward edge of the shroud 22 with the weight 25. The weight provides the necessary weight on the cutting edge 28 which will later be described.

The handle bar 29 comprises a pair of elongated tubular members 30 which are attached at their lower ends to the shroud 22, and at their upper ends are joined by tubular cross members 31 and 32. Hand grips 33 are used to handle and maneuver the machine 10.

Figure 3:
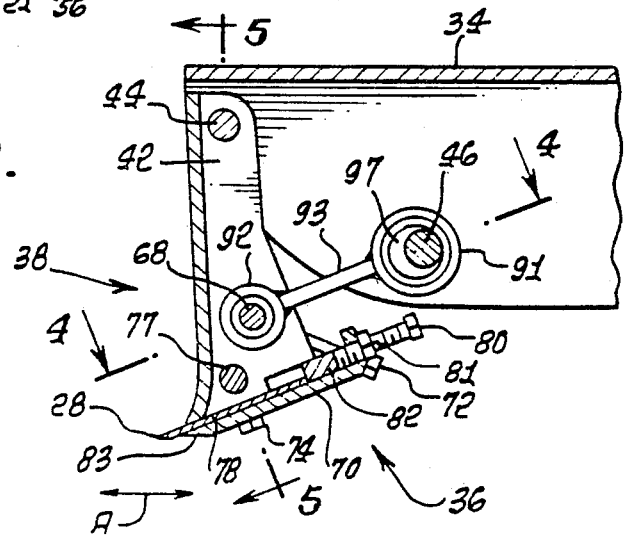
FIG. 3 is an enlarged elevation taken on lines 3—3 of FIG. 4.
Figure 4:
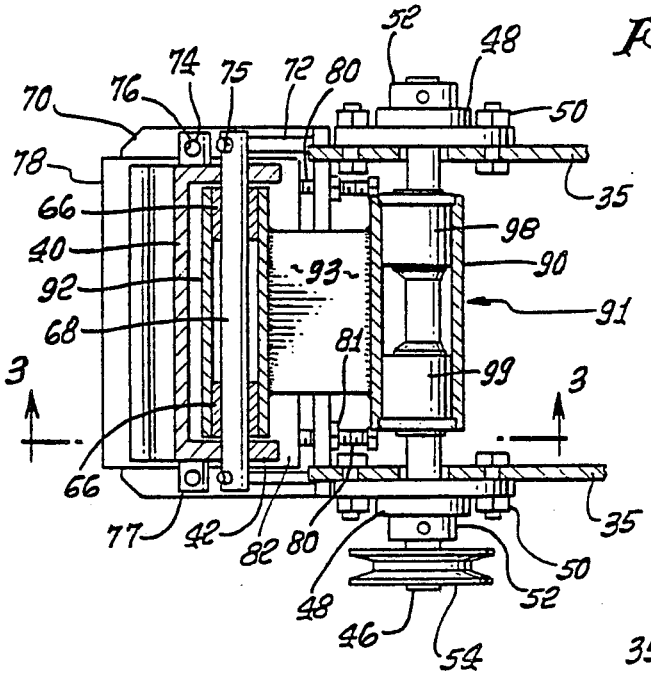
FIG. 4 is a section taken on lines 4—4 of FIG. 3.
Figure 5:
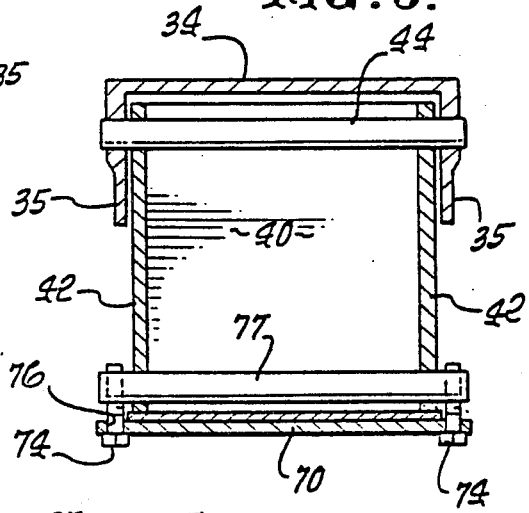
FIG. 5 is a section taken on lines 5—5 of FIG. 3.
Figure 6:
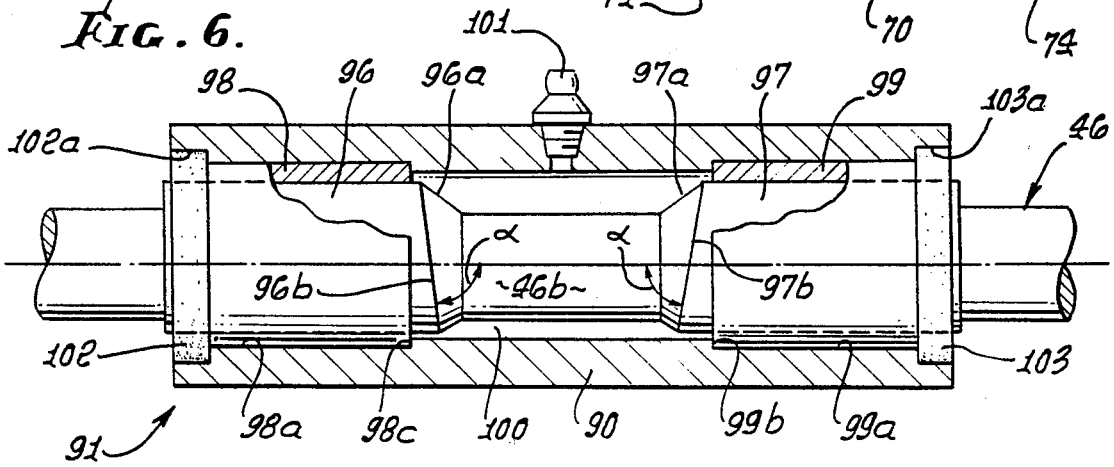
FIG. 6 is an enlarged section taken through connecting structure seen in FIG. 4.

FIGS. 3 through 5 show the cutter head subassembly 36 in detail. The frame 16 previously mentioned is substantially U-shaped with a horizontal web portion 34 and a pair of vertical flanges 35 as can best be seen in FIG. 5. At the forward end of the frame 16 positioned between the webs 35 is the cutting head 38. The head 38 is formed with a web 40 and a pair of flanges 42. The cutting head is pivotally mounted at the upper end to the frame 16 by a pin 44 which passes through both pairs of flanges 35 and 42. Passing through the pair of flanges 35 and journalled thereto is a rotatably mounted drive shaft 46 which is shown in FIGS. 4 and 6. The shaft 46 is journalled at its outer ends in a pair of roller bearings 48 which are in turn bolted to the frame flanges 35 by means of bolts 50. Retaining the cam shaft in the bearings 48 are a pair of locking sleeves 52 which are mounted on the shaft 46 immediately outward of the bearings 48. Keyed to one end of the shaft 46 is a sheave 54 adapted to carry a V-belt. Mounted on the shaft 56 of the motor 18 is a similar sheave 58 which lies in the same plane of rotation as sheave 54. The two sheaves 54 and 58 are connected by means of a rubber V-belt 21. The tension in the V-belt 21 may be adjusted as previously discussed.

Figure 7:
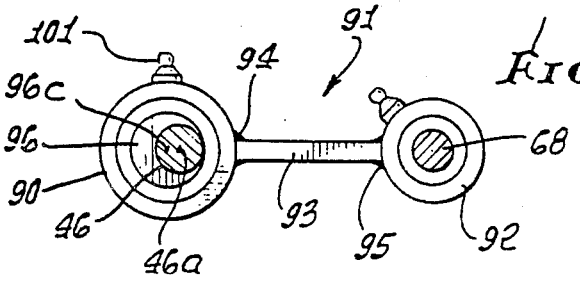
FIG. 7 is an end elevation view of the FIG. 6 connecting structure.

The shaft 46 extends within a first tubular part 90 of a connecting element 91, the latter also incorporating a second and smaller diameter tubular part 92. Those tubular parts may advantageously and inexpensively comprise steel pipe sections, interconnected by a steel plate 93 which is simply welded to outer side portions of the sections, as at 94 and 95. See FIG. 7. Accordingly, the cost of element 91 is minimized.

Shaft 46 carries two axially spaced eccentrics 96 and 97. See in FIG. 7 the axis 96*a* of eccentric 96 offset from the axis 46*a* of shaft 46. Each eccentric is cylindrical, to rotate within a bearing, such as a bushing, the two bushings indicated at 98 and 99 and received in counterbores 98*a* and 99*a* in the pipe section, and against step shoulders 98*b* and 99*b*. The large space 100 thus provided between the eccentrics provides a lubricant (grease) reservoir, for long lasting lubrication of the two bearings, as the shaft rotates and on the eccentrics oscillate the shaft section 90, and the element 91 back and forth, as will be described. Shaft section 46*b* extends between and interconnects the two eccentrics.

Note that the eccentrics have oppositely facing end portions or faces 96*a* and 97*a*, which, due to their flaring eccentricity, tend to positively displace the grease as the eccentrics rotate. This serves to urge grease radially outwardly, and axially toward the bushings and the bearing surfaces of the eccentrics and bushings, for enhancement of lubrication. Note that faces 96*a* and 97*a* intersect the outer surfaces of the eccentrics in planes 96*b* and 97*b* that are at angles $\alpha$ relative to the shaft axis, angles $\alpha$ being less than 90°. Grease is introduced to space 100 via a grease fitting 101 in shaft 90, as shown.

Annular elastomeric seals 102 and 103 are located at opposite ends of the bushings, and pressed into the shaft counterbores 102*a* and 103*a*, as shown. Those seals exert pressure on the shaft eccentrics to prevent escape of grease.

At the opposite end of element 91 is a bearing shaft 68 journaled via bushings 66 to the pipe section 92. Shaft 68 is in turn mounted to cutting head 38. When shaft 56 is rotated, element 91 is oscillated back and forth to cause head 38 to move back and forth about the axis of pipe 44, as indicated by arrows A in FIG. 3.

At the lower extremities of the cutting head 38 the flanges 42 become wider to accommodate the cutting blade shoe 70. The shoe 70 is adjustably held against the cutting head by two pairs of bolts 72 and 74. The bolts 72 pass through openings 75 in the rear of the blade shoe 70 and are threaded into the ends of the connecting rod shaft 58. The bolts 74 pass through openings 76 and are threaded into the ends of shaft 77. The purpose of the blade shoe 70 is to rigidly hold the cutting blade 78 in its cutting position. Located on the back edge of the blade shoe 70 are a pair of adjusting bolts 80 and locking nuts 81 which allow for adjustment of the position of the blade stop 82 which in turn adjusts the amount of blade edge exposure. The front edge 83 of the blade shoe 70 is tapered to provide a maximum amount of rigidity to the cutting blade and yet permit a shallow angle of slope between the cutting blade 78 and the flooring surface being stripped.

Figure 8:
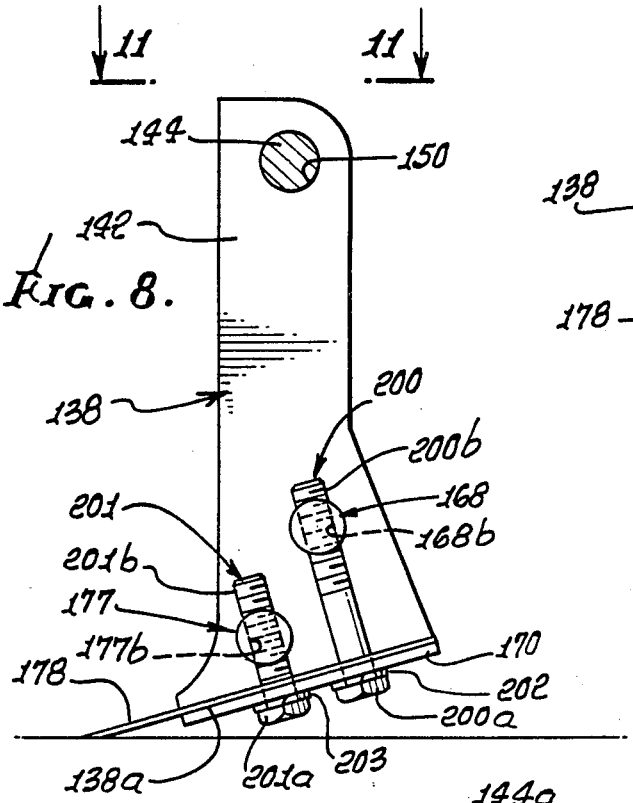
FIG. 8 is a side elevation.
Figure 10:
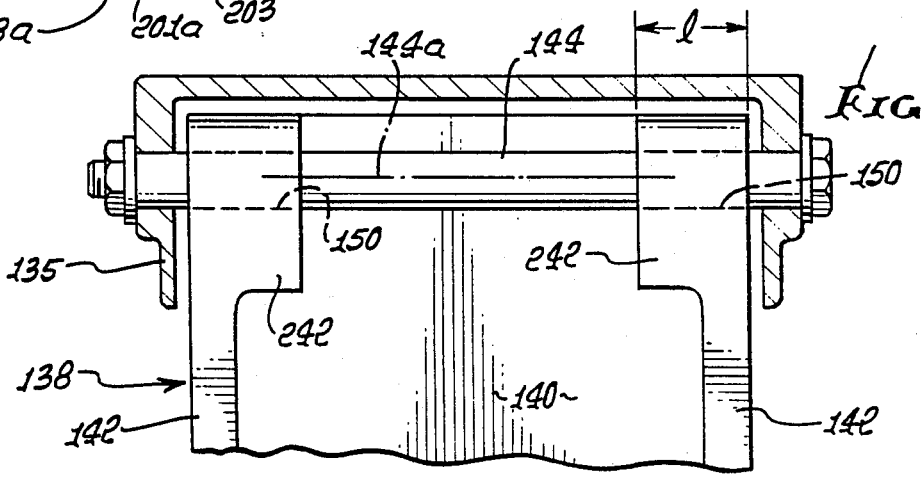
FIG. 10 is a fragmentary front elevation, showing the head of FIG. 8.
Figure 11:
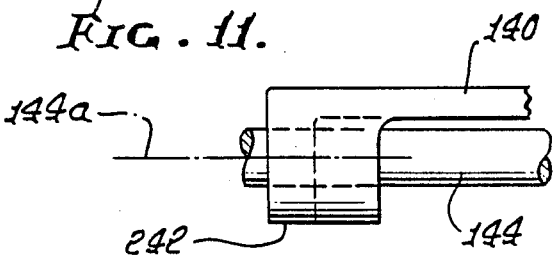
FIG. 11 is a fragmentary plan view on lines 11—11 of FIG. 8.

FIGS. 8, 10 and 11 show a modified head 138 consisting of lightweight metal such as aluminum, or aluminum alloys, or magnesium, or magnesium alloys. The head has two elongated flanges 142 interconnected by a web 140. The flanges are locally thickened near upper ends of the flanges to define two widened lugs 242 that form widened bearing openings 150 for a pivot shaft 144. The latter is connected to the frame flanges 135 (corresponding to flanges 35 in FIG. 5). The bearing openings (and the lugs) have lengths "1" in excess of $\frac{3}{4}$ inch, and preferably are between $\frac{3}{4}$ and $1\frac{1}{2}$ inches in length. As a result, destructive wear of the head metal surrounding the openings 150 is eliminated, and in particular for heavy duty operation where stripping forces are extensive.

Figure 11A:
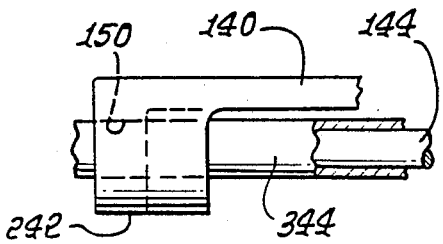
FIG. 11*a* is a view like FIG. 11.

The openings are sized to closely receive the pivot shaft 144, and define a common axis 144*a*. FIG. 11*a* shows a modification, with a steel tube 344 received in openings 150, and in turn receiving the shaft 144. Tube 344 helps distribute loading to insure against destructive wear of the lightweight metal lugs 242.

Figure 9:
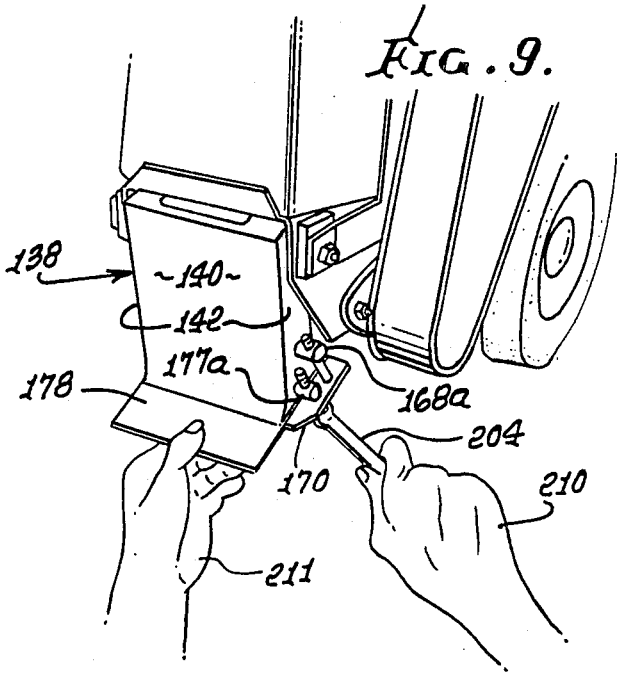
FIG. 9 is a perspective view.

FIGS. 8 and 9 also show the use of the modified blade holder pate 170 attached to the head 138 at its bottom side 138*a*. Blade 178 is clamped against that side, by the plate. Two shafts, 177 and 168 extend parallel to the web 140 and through flanges 142 to provide shaft projections 177*a* and 168*a* at the exterior side of each flange. Two pairs of fasteners 200 and 201 extend in parallel relation through suitable openings in the holder plate and in the blade, at opposite ends of the shafts, respectively. The fasteners have heads 200*a* and 201*a* that clamp split washers 202 and 203 against the bottom of the holder plate. Also, the fasteners have threaded shanks 200*b* and 201*b* received in threaded engagement with threaded openings 177*b* and 168*b* in the shaft projections 177*a* and 168*a*. Accordingly, tightening of the blade in position as shown in FIG. 9 may be accomplished using one hand 210 only, i.e. by manipulation of the wrench 204 in grip engagement with the fastener heads, and the blade may be held and positioned by the other hand 211.

The operation of the stripping machine 10 varies with the type of floor being removed. The steeper the angle of the blade 78 with the floor the deeper the blade will dig. The angle can be varied by lifting the wheels 12 off the floor. The angle can also be varied by extending the blade 78 further past the edge of the shoe 70. When removing a plywood or particle board floor an extra long blade which extends an additional four inches or more past the edge of the shoe 70 has proven very useful. The longer the blade 78 is extended out of the shoe the less the angle between the cutting blade and floor. The amount of weight applied to the cutting edge 28 is also variable depending upon the flooring being removed. The weight can be varied by the amount of pressure applied by the hands to the handle bar 29. Generally, the machine best operates when the handle bar 29 is lifted up until the wheels are one-half inch off the floor. When an exceptionally tough flooring is being removed, a blade with teeth formed on the cutting edge has been found to be very effective.

Figure 12:
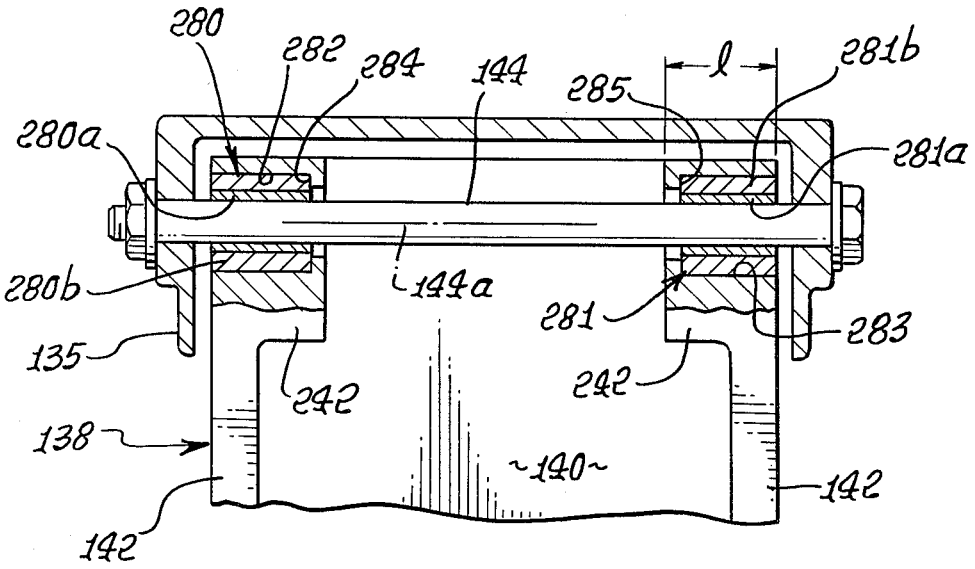
FIG. 12 is a view like FIG. 10, but showing a modification.

FIG. 12 is a view like FIG. 10, with corresponding elements having the same identifying numbers. It differs from FIG. 10 in the provision of bushings 280 and 281 fitted and retained in bores 282 and 283 in lugs 242. The bushings may endwise fit against stop shoulders 284 and 285 in the lugs. The bushings may advantageously be self-lubricated, as provided by annular material 280*a* and 281*a* carried in metallic (as for example bronze) sleeves 280*b* and 281*b* press-filled in bores 282 and 283. Material 280*a* and 281*a* may for example consist of molybdenum disulfide. One example of such bushings are known "OILITE" bushings.

Pivot shaft 144 (typically steel) is received in, and has low friction running fit in, the bores of the annuli 280*a* and 281*a*, for long lasting, low wear operation.

I claim:

1. For use in power-operated floor stripping apparatus that includes a frame, a drive carried on the frame, wheels supporting the frame, a handle to guide the frame, and a cutting blade carried by a head which is pivotally mounted to the frame, the improvement comprising (a) a connecting element having a first tubular part and a second tubular part, said parts having spaced parallel axes, said second tubular part pivotally connected to the head, (b) a drive shaft extending within said first tubular part, said shaft operatively connectible to the drive to be rotated thereby, (c) said drive shaft carrying two axially spaced eccentrics to be rotated by the shaft, there being a lubricant receiving space located directly between said eccentrics, (d) two annular bearings respectively carried by and within said first tubular part, said bearings respectively receiving said spaced eccentrics to oscillate said first tubular part, said head and said blade as said eccentrics are rotated by the shaft, (e) said head consisting of lightweight metal and having two flanges interconnecting by a web, the flanges being locally thickened to substantial extent to define two lugs, (f) and bearing bushings received in and carried by said lugs to form bearing openings for a pivot shaft connected to the frame, said bushings being self-lubricated adjacent the shaft.

2. The improvement of claim 1 wherein said bearing openings in said bushings have lengths in excess of $\frac{3}{4}$ inch.

3. The improvement of claim 1 including said pivot shaft closely received in said bearing openings.

4. The improvement of claim 1 including a blade holder plate attached to the head at the bottom side thereof, two shafts extending parallel to said head web and through said head flanges to provide shaft projections exteriorly of said flanges, and fasteners extending through said holder plate and having threaded shanks in threaded engagement with threaded openings in said shaft projections, the fasteners having heads below said holder plate to be rotated for clamping the blade between the plate and the head bottom side.

5. The improvement of claim 1 including said frame, drive, wheels, handle, and cutting blade clamped to said holder plate.

6. For use in power-operated floor stripping apparatus that includes a frame, a drive carried on the frame, wheels supporting the frame, a handle to guide the frame, a cutting blade carried by a head which is pivotally mounted to the frame, a connecting element having a first tubular part and a second tubular part, said parts having spaced, parallel axes, said second tubular part pivotally connected to the head, and a drive shaft extending within said first tubular part, said shaft operatively connected to the drive to be rotated thereby, the improvement comprising (a) said head consisting of lightweight metal selected from the group consisting of aluminum, aluminum alloys, magnesium and magnesium alloys, (b) the head having two elongated flanges interconnected by a web, the flanges being locally thickened near upper ends of the elongated flanges to define two lugs, (c) bearing bushings received in said lugs to define bearing openings defining a pivot axis parallel to said drive shaft, the bearing openings receiving a bearing shaft connected to the frame, (d) and including a blade holder plate attached to the head at the bottom side thereof, two shafts extending parallel to said head web and through said head flanges to provide shaft projections exteriorly of said flanges, and fasteners extending through said holder plate and having threaded shanks in threaded engagement with threaded openings in said shaft projections, the fasteners having heads below said holder plate to be rotated for clamping the blade between the plate and the head bottom side.

7. The improvement of claim 6 including said first and second tubular parts comprising sections of pipe having different outer diameters, and including plate structure interconnecting said pipe sections.

8. For use in power-operated floor stripping apparatus that includes a frame, a drive carried on the frame, wheels supporting the frame, a handle to guide the frame, and a cutting blade carried by a head which is pivotally mounted to the frame, the improvement comprising (a) a connecting element having a first tubular part and a second tubular part, said parts having spaced, parallel axes, said second tubular part pivotally connected to the head, (b) a drive shaft extending within said first tubular part, said shaft operatively connected to the drive to be rotated thereby, (c) said drive shaft carrying two axially spaced eccentrics to be rotated by the shaft, there being a lubricant receiving space located directly between said eccentrics, (d) two annular bearings respectively carried by and within said first tubular part, said bearings respectively receiving said spaced eccentrics to oscillate said first tubular part, said head and said blade as said eccentrics are rotated by the shaft, (e) said head consisting of lightweight metal having two flanges connected by a web, the flanges locally thickened to define two lugs, (f) and bearing bushings received in and carried by said lugs to form bearing openings for a pivot shaft connected to the frame, said bushings being self-lubricated adjacent the shaft.

9. The combination of claim 8 wherein said eccentrics have oppositely facing end faces which flare radially outwardly and axially away from said space, to urge and guide lubricant toward said bearings.

10. The combination of claim 9 wherein said bearings comprise bushings.

11. The combination of claim 10 including lubricant seals at the ends of said bearings furthest from said lubricant space, said seals fitting annularly to the first tubular part.

12. The combination of claim 9 wherein said eccentrics are integral with the shaft.

13. The combination of claim 9 wherein said end faces intersect the outer cylindrical surfaces of the eccentrics in planes extending at angles $\alpha$ relative to the shaft axis, said angles $\alpha$ being less than 90°.

14. The combination of claim 8 wherein at least one of said tubular parts comprises a section of pipe.

15. The combination of claim 8 wherein said first and second tubular parts comprise sections of pipe having different outer diameters, and including intermediate structure interconnecting said pipe sections.

16. The combination of claim 15 wherein said intermediate structure comprises a plate welded to said pipe sections.

* * * * *